US010636278B2

(12) United States Patent
Krishnamoorthy et al.

(10) Patent No.: US 10,636,278 B2
(45) Date of Patent: Apr. 28, 2020

(54) SYSTEMS AND METHODS FOR ARMING A SECURITY SYSTEM

(71) Applicant: Ademco Inc., Golden Valley, MN (US)

(72) Inventors: Samidurai Krishnamoorthy, Thanjavur (IN); Balamurugan Ganesan, Bangalore (IN); Praveen Kumar, Bengaluru (IN)

(73) Assignee: ADEMCO INC., Golden Valley, MN (US)

( * ) Notice: Subject to any disclaimer, the term of this patent is extended or adjusted under 35 U.S.C. 154(b) by 0 days.

(21) Appl. No.: 16/263,179

(22) Filed: Jan. 31, 2019

(65) Prior Publication Data

US 2019/0244511 A1 Aug. 8, 2019

Related U.S. Application Data

(60) Provisional application No. 62/625,450, filed on Feb. 2, 2018.

(51) Int. Cl.

| | |
|---|---|
| ***G08B 25/00*** | (2006.01) |
| ***G08B 13/24*** | (2006.01) |
| ***G08B 29/18*** | (2006.01) |
| ***G08B 13/00*** | (2006.01) |

(52) U.S. Cl.

CPC ..... *G08B 25/008* (2013.01); *G08B 13/2491* (2013.01); *G08B 29/185* (2013.01); *G08B 13/00* (2013.01)

(58) Field of Classification Search

CPC . G08B 25/008; G08B 13/2491; G08B 29/185
See application file for complete search history.

(56) References Cited

U.S. PATENT DOCUMENTS

| | | | | |
|---|---|---|---|---|
| 7,965,171 | B2 | 6/2011 | Hershkovitz | |
| 9,508,250 | B2 | 11/2016 | Malhotra et al. | |
| 9,646,482 | B1 | 5/2017 | Herman et al. | |
| 2004/0090327 | A1* | 5/2004 | Soloway | G08B 13/08 340/545.1 |
| 2005/0128068 | A1* | 6/2005 | Winick | B60R 25/1004 340/517 |
| 2007/0247302 | A1* | 10/2007 | Martin | G08B 25/008 340/506 |

(Continued)

FOREIGN PATENT DOCUMENTS

| | | | |
|---|---|---|---|
| WO | 2016/109040 | A1 | 7/2016 |
| WO | WO 2016/109138 | A1 | 7/2016 |

OTHER PUBLICATIONS

Extended European search report from corresponding EP patent application 19155081.3, dated Jul. 4, 2019.

*Primary Examiner* — Emily C Terrell
*Assistant Examiner* — Rufus C Point
(74) *Attorney, Agent, or Firm* — Husch Blackwell LLP

(57) ABSTRACT

Systems and methods for arming a security system are provided. Such systems and methods can include a control device of the security system that protects a monitored region with a plurality of sensors receiving user input while the security system is in a first arm mode, and responsive to the user input, the security system directly transitioning from the first arm mode to a second arm mode without switching to a disarm mode in between the first arm mode and the second arm mode.

20 Claims, 5 Drawing Sheets

(56) References Cited

U.S. PATENT DOCUMENTS

| | | | | |
|---|---|---|---|---|
| 2007/0257790 | A1* | 11/2007 | Hershkovitz | G08B 25/008 340/528 |
| 2010/0026487 | A1* | 2/2010 | Hershkovitz | G08B 25/008 340/541 |
| 2013/0257611 | A1 | 10/2013 | Lamb et al. | |
| 2015/0279198 | A1* | 10/2015 | Gu | G08B 13/19656 340/541 |
| 2016/0189496 | A1* | 6/2016 | Modi | G08B 13/08 340/545.2 |
| 2016/0189527 | A1* | 6/2016 | Peterson | G08B 25/008 340/541 |
| 2016/0189528 | A1 | 6/2016 | Lee et al. | |
| 2016/0267774 | A1 | 9/2016 | Janardhanan | |
| 2016/0343237 | A1* | 11/2016 | Herman | G08B 25/008 |
| 2017/0193809 | A1* | 7/2017 | Dey | G08B 25/008 |

* cited by examiner

SYSTEMS AND METHODS FOR ARMING A SECURITY SYSTEM

CROSS REFERENCE TO RELATED APPLICATIONS

This application claims priority to U.S. Provisional Patent Application No. 62/625,450 filed Feb. 2, 2018 and titled "SYSTEMS AND METHODS FOR ARMING A SECURITY SYSTEM." U.S. Provisional Patent Application No. 62/625,450 is hereby incorporated by reference.

FIELD

The present invention relates generally to security systems. More particularly, the present invention relates to systems and methods for arming a security system.

BACKGROUND

Known security systems include several disadvantages, some of which are described below and some of which are illustrated in FIG. 1, which is a flow diagram of an arming method 100 known in the art.

First, to switch between two arming modes, known security systems must enter a disarm mode in between the two arming modes. U.S. Publication No. 2007/0257790 describes a known security system operating in an arm stay mode, detecting an opening of a perimeter or entry door, and switching to or staying in the arm stay mode without switching to the disarm mode. However, to switch from an arm away mode to the arm stay mode, the security system must switch from the arm away mode to the disarm mode before switching from the disarm mode to the arm stay mode. This is a two-step process for one mode change. Furthermore, while in the disarm mode, a region monitored by the security system is vulnerable to threats, especially if a user disarms the security system and fails to enter or leave the region prior to arming the security system.

Second, when entering one of the two arming modes activates a home automation scene in the region, switching from the arm away mode to the disarm mode can activate the home automation scene and switching from the disarm mode to the arm stay mode can activate the home automation scene again, thereby creating annoyance to the user, including changes to lights, locks, thermostats, and other consumer products. Furthermore, such unnecessary activation of the home automation scene can create wear and tear on any appliances associated with the home automation scene.

Third, known security systems include a keypad permanently mounted on a wall. Accordingly, known security systems provide an entry or exit delay long enough for the user to enter or exit the region to access the keypad to arm or disarm the security system. However, such an entry or exit delay creates a window of time during which the region is vulnerable to the threats.

Notwithstanding the above-identified disadvantages of known security systems, Do It Yourself (DIY) security systems are becoming more prevalent in the marketplace and include mobile applications and/or wireless keyfobs as user interfaces for controlling the security systems without the keypad permanently mounted on the wall.

In view of the above, there is a need and an opportunity for improved systems and methods for arming a security system.

DETAILED DESCRIPTION

Figure 1:
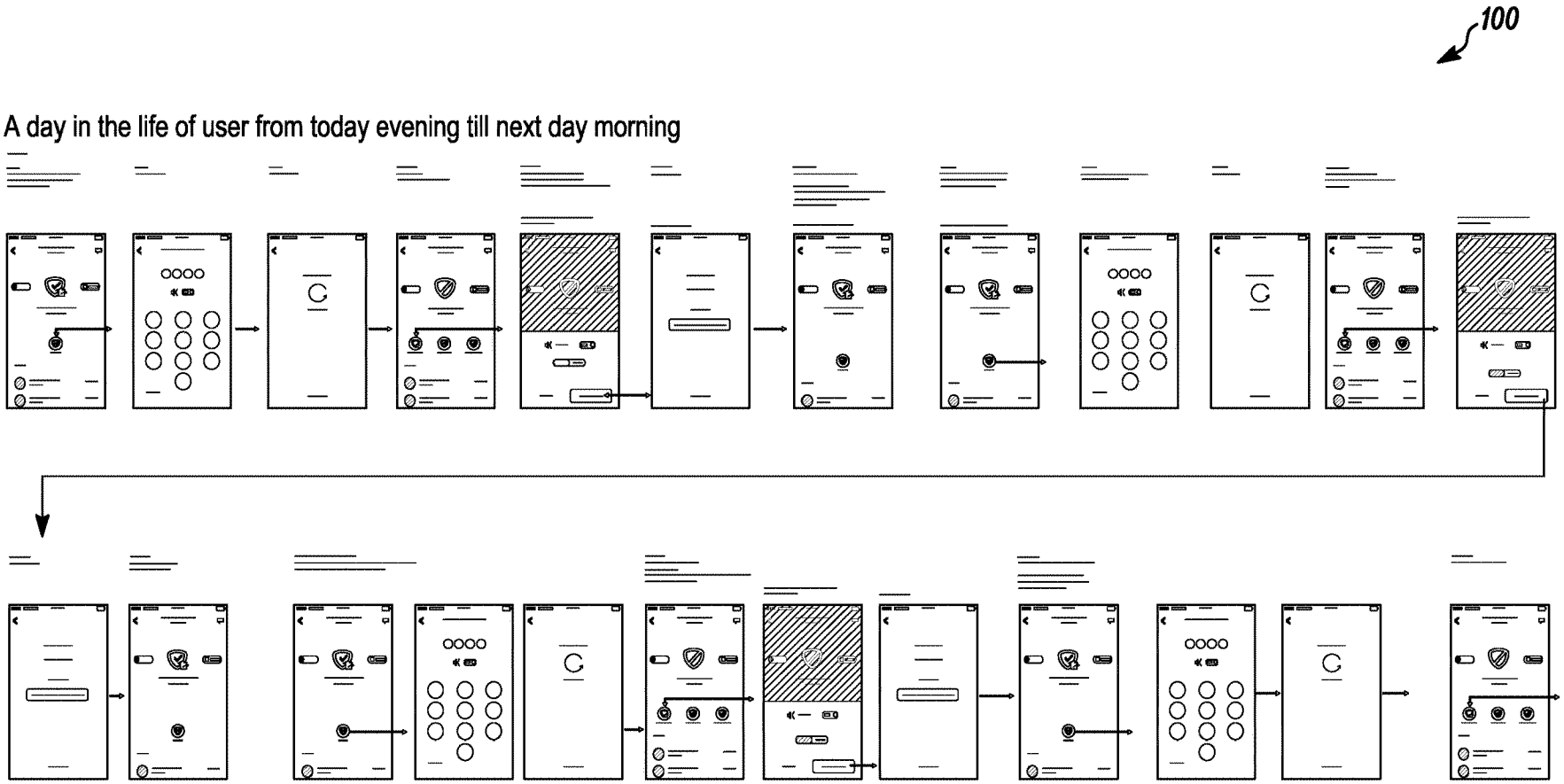
(Prior art) FIG. 1
FIG. 1 is a flow diagram of an arming method known in the art.

While this invention is susceptible of an embodiment in many different forms, specific embodiments thereof will be described herein in detail with the understanding that the present disclosure is to be considered as an exemplification of the principles of the invention. It is not intended to limit the invention to the specific illustrated embodiments.

Embodiments disclosed herein can include systems and methods for arming a security system that can include directly transitioning the security system from a first arm mode to a second arm mode without switching to a disarm mode in between the first arm mode and the second arm mode. For example, when the security system is in the first arm mode, a control device for the security system can receive user input requesting that the security system transition to the second arm mode, and responsive thereto, the security system can directly transition from the first arm mode to the second arm mode without switching to the disarm mode in between the first arm mode and the second arm mode.

In some embodiments, systems and methods disclosed herein can include switching the security system directly from an arm away mode to an arm stay mode (an active mode), switching the security system directly from the arm stay mode to an arm night mode (a sleep mode), switching the security system directly from the arm night mode to the arm stay mode, and/or switching the security system directly from the arm stay mode to the arm away mode in all without switching to the disarm mode in between any of these arming modes. Accordingly, systems and methods disclosed herein can switch between the arming modes in one step, thereby reducing unnecessary switching of and unnecessary wear and tear on appliances associated with home automation scenes associated with the arming modes.

In some embodiments, in which of the arming mode the security system is operating in can determine which of a plurality of sensors of the security system can trigger an alarm signal when respective alarm conditions monitored by each of the plurality of sensors are detected. For example, when the security system is operating in the first arm mode, each of a first set of the plurality of sensors can detect any of the respective alarm conditions associated therewith and, responsive thereto, the security system can activate the alarm signal. However, when the security system is operating in the second arm mode, each of a second set of the plurality of sensors can detect any of the respective alarm conditions associated therewith and, responsive thereto, the security system can activate the alarm signal.

In some embodiments, the first set of the plurality of sensors can be at least partially different from the second set of the plurality of sensors. For example, in some embodiments, in the arm away mode, all of the plurality of sensors can trigger the alarm signal when any of the plurality of sensors detects the respective alarm conditions associated therewith. However, in the arm stay mode, any of the plurality of sensors that can detect movement or other security related threats within an interior area of a region monitored by the security system can be deactivated while any of the plurality of sensors that can detect the respective alarm conditions associated therewith at or proximate to a perimeter of the region can be activated and trigger the alarm signal, thereby allowing a user of the security system to be present within the interior area of the region while having some alarm protection from security events that occur at or proximate to the perimeter of the region. In the arm night mode, any of the plurality of sensors that can detect movement or other security related threats within predetermined zones of the region, such as bedrooms, bathrooms, or a second floor of the region, can be deactivated while any of the plurality of sensors that can detect the respective alarm conditions associated therewith outside of the predetermined zones can be activated and trigger the alarm signal.

It is known that the security system can switch from the arm away mode to the disarm mode or from the disarm mode to the arm stay mode. Thereafter, the user may receive an emergency call or the like and forget to switch the security system to the arm away mode before leaving the region to attend to the emergency call. Under these circumstances and in accordance with disclosed embodiments, systems and methods disclosed herein can include automatically switch the security system from the disarm mode or the arm stay mode to the arm away mode responsive to a failure to detect an opening of or access to or from the region via an entry door within a predetermined period of time after switching to or entering the disarm mode or the arm stay mode. That is, in some embodiments, systems and methods disclosed herein can automatically switch the security system from the disarm mode or the arm stay mode to the arm away mode without receiving user input with explicit instructions to do so. In some embodiments, systems and methods disclosed herein can transmit an audio and/or visual push notification to the user to notify the user about the security system automatically switching to the arm away mode.

It is also known that the security system can provide an entry or exit delay during which the user can open and close the entry door any number of times. However, these circumstances may leave the region unsecured, for example, when the entry or exit delay is long and the user leaves the region quickly. Accordingly, in accordance with disclosed embodiments, during the entry or exit delay, systems and methods disclosed herein can automatically switch to a preselected mode, such as the arm away mode or the arm stay mode, responsive to detecting a closing of the entry door, thereby automatically terminating the entry or exit delay.

For example, in some embodiments, responsive to user input requesting that the security system transition from the arm stay mode or the disarm mode to the arm away mode, the security system can activate an exit delay timer and suppress activation of the alarm signal responsive to any of the plurality of sensors detecting the respective alarm conditions associated therewith until expiration of the exit delay timer. Then, responsive to one of the plurality of sensors that monitors the entry door being triggered after activation of the exit delay timer and prior to the expiration of the exit delay timer, systems and methods disclosed herein can transition the security system directly to the arm away mode and terminate the exit delay timer. Additionally or alternatively, responsive to all of the plurality of sensors that monitor the entry door failing to be triggered after the activation of the exit delay timer and prior to the expiration of the exit delay timer, systems and methods disclosed herein can transition the security system directly to the arm stay mode or the disarm mode (or refrain from transitioning the security system out of the arm stay mode or the disarm mode) when the exit delay timer or the entry delay timer expires. Additionally or alternatively, responsive to all of the plurality of sensors that monitor the entry door failing to be triggered after the activation of the exit delay timer and prior to the expiration of the exit delay timer, systems and methods disclosed herein can transition the security system directly to the arm stay mode or the disarm mode (or refrain from transitioning the security system out of the arm stay mode or the disarm mode) when the exit delay timer expires and when any of the plurality of sensors detects a presence of the user within the interior area of the region.

Similarly, in some embodiments, responsive to user input requesting that the security system transition from the arm away mode to the arm stay mode or the disarm mode, the security system can activate an entry delay timer and suppress the activation of the alarm signal responsive to any of the plurality of sensors detecting the respective alarm conditions associated therewith until the expiration of the entry delay timer. Then, responsive to the one of the plurality of sensors that monitors the entry door being triggered after activation of the entry delay timer and prior to the expiration of the entry delay timer, systems and methods disclosed herein can transition the security system directly to the arm stay mode or the disarm mode and terminate the entry delay timer. Additionally or alternatively, responsive to all of the plurality of sensors that monitor the entry door failing to be triggered after the activation of the entry delay timer and prior to the expiration of the entry delay timer, systems and methods disclosed herein can transition the security system directly to the arm away mode (or refrain from transitioning the security system out of the arm away mode) when the entry delay timer expires. Additionally or alternatively, responsive to all of the plurality of sensors that monitor the entry door failing to be triggered after the activation of the entry delay timer and prior to the expiration of the entry delay timer, systems and methods disclosed herein can transition the security system directly to the arm stay mode or the disarm mode when the entry delay timer expires and when any of the plurality of sensors detects the presence of the user within the interior area of the region.

Figure 2:
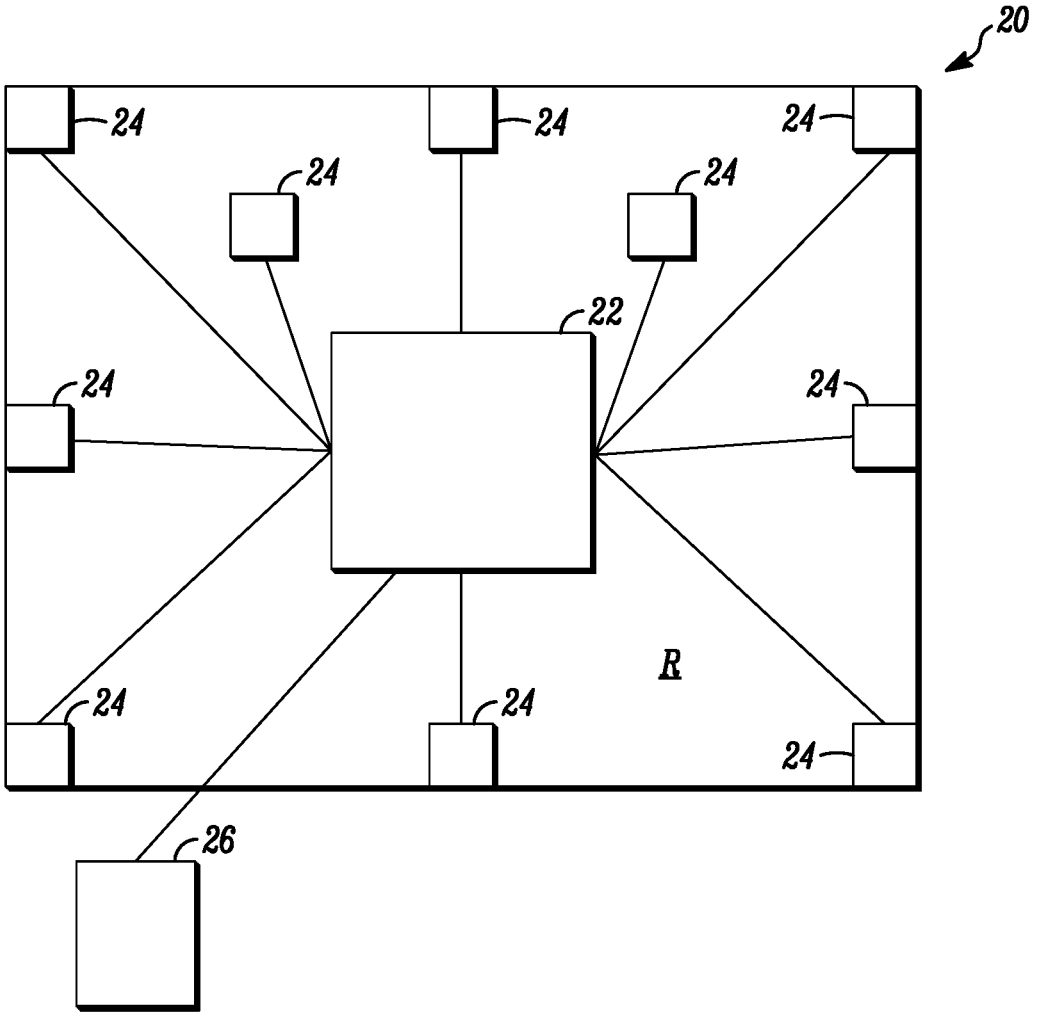
FIG. 2 is a block diagram of a system in accordance with disclosed embodiments.

FIG. 2 is a block diagram of a security system 20 in accordance with disclosed embodiments. As seen in FIG. 2, the security system 20 can include a control panel 22, a plurality of sensors 24 deployed in a region R, and a control or user interface device 26. The control panel 22 can communicate with each of the plurality of sensors 24 and the control or user interface device 26 using wired or wireless mediums. In some embodiments, the control or user interface device 26 can be integrated into the control panel 22, and in some embodiments, the control or user interface device 26 can include a mobile device that can communicate with the control panel 22 via a wide area network, such as the internet.

Figure 3:
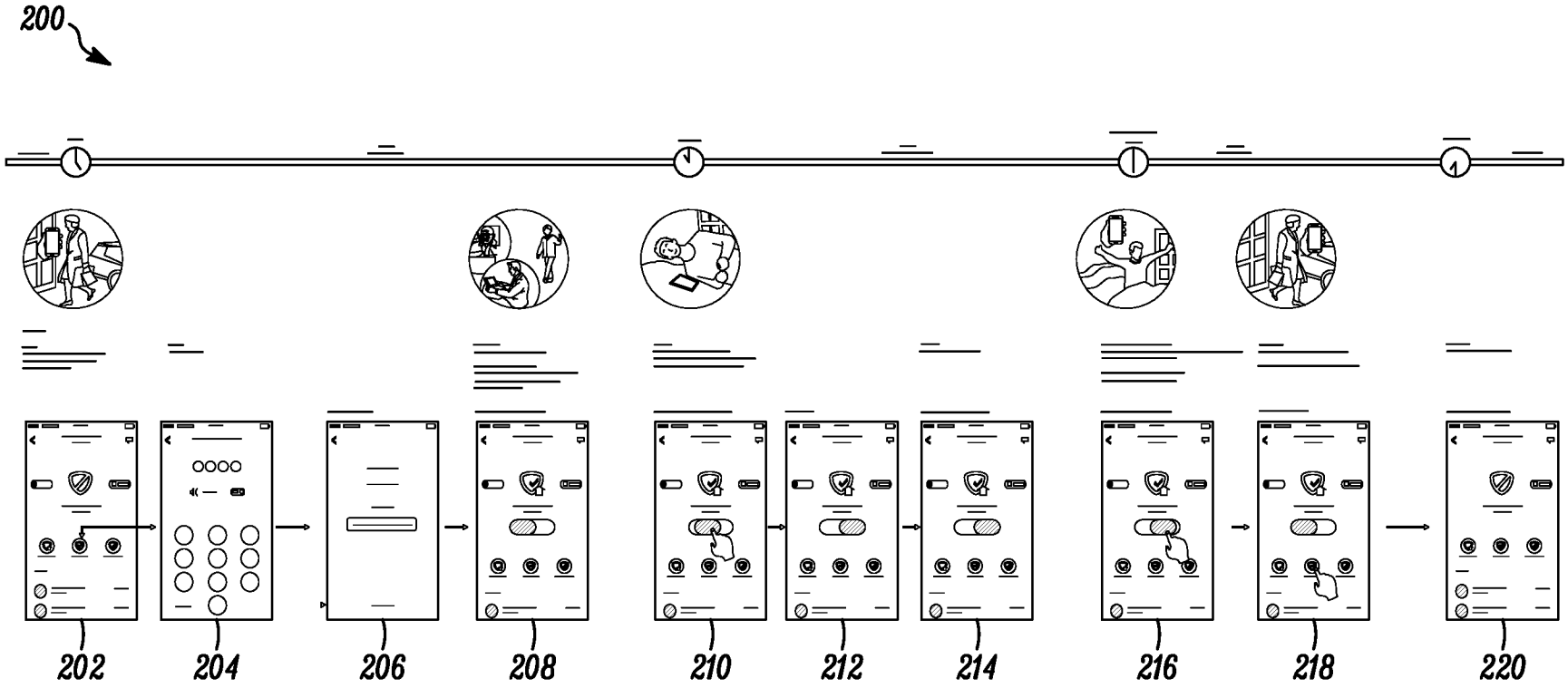
FIG. 3 is a flow diagram of an arming method in accordance with disclosed embodiments.

FIG. 3 is a flow diagram of an arming method 200 in accordance with disclosed embodiments. Relative to the arming method 100 of FIG. 1 known in the art, the arming method 200 requires less user interaction with and user input to a mobile application and fewer mode changes in the security system 20.

As seen in FIG. 3, the method 200 can include the control or user interface device 26 receiving user input with instructions to transition the security system 20 from an arm away mode to an arm stay mode, as in 202. Responsive thereto, the method 200 can include the control or user interface device 26 can soliciting a pin or a passcode from a user, as in 204, and when the pin or the passcode is valid, activating an entry delay timer, as in 206. After expiration of the entry delay timer, the method 200 can include the security system 20 transitioning directly to the arm stay mode, as in 208.

Furthermore, the method 200 can include the control or user interface device 26 receiving user input with instructions to transition the security system 20 from the arm stay mode to an arm night mode, as in 210. Responsive thereto and after expiration of a predetermined period of time, as in 212, the method 200 can include the security system transitioning directly to the arm night mode, as in 214.

Further still, the method 200 can include the control or user interface device 26 receiving user input with instructions to transition the security system 20 from the arm night mode to the arm stay mode, as in 216. Responsive thereto, the method 200 can include the security system 20 transitioning directly to the arm away mode and the control or user interface device 26 receiving user input with instructions to transition the security system 20 from the arm stay mode to the arm away mode, as in 218. Responsive thereto, the method 200 can include the security system 20 transitioning directly to the arm away mode, as in 220.

Figure 4:
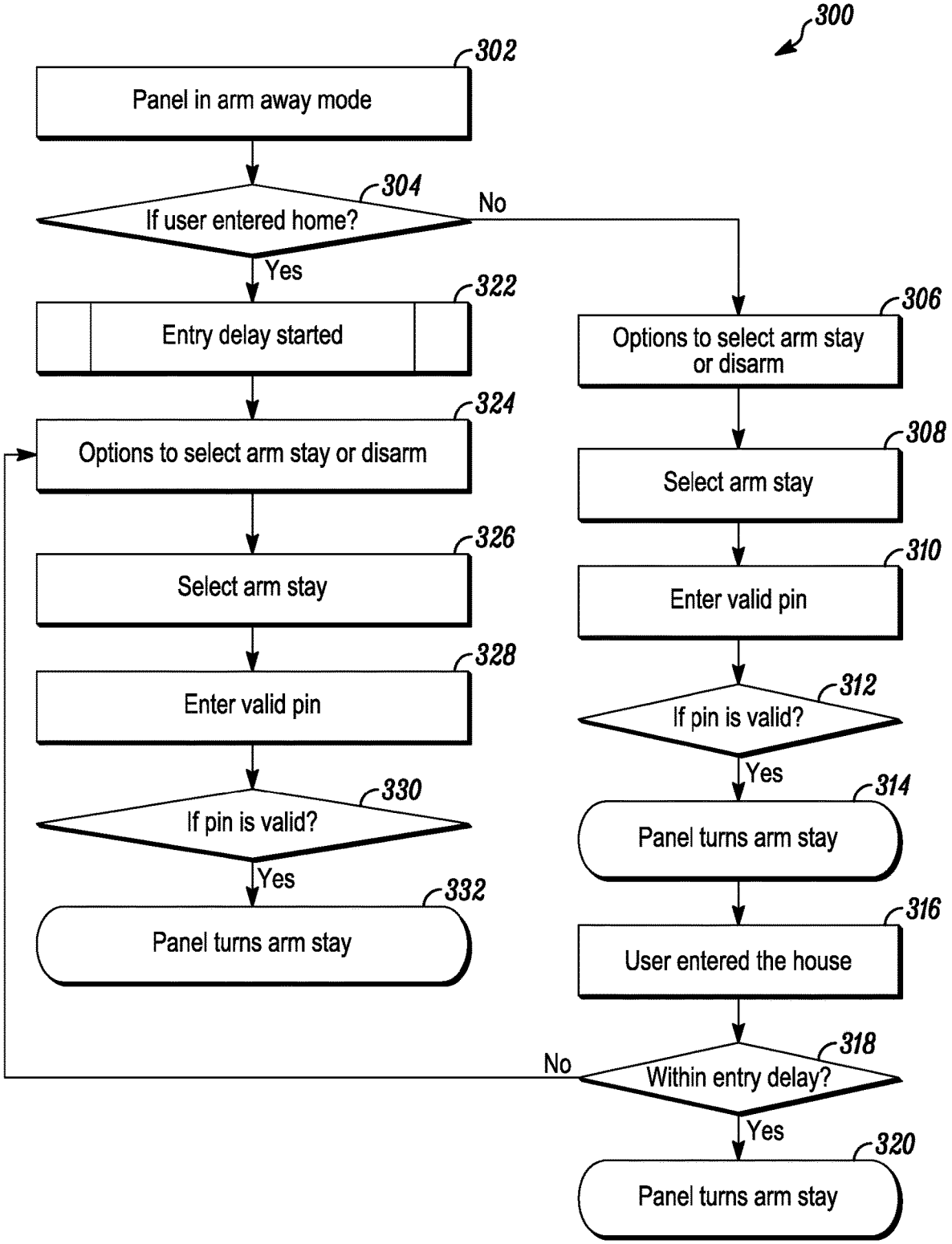
FIG. 4 is a flow diagram of a method of switching between an arm away mode and an arm stay mode in a security system in accordance with disclosed embodiments.

FIG. 4 is a flow diagram of a method 300 of switching between the arm away mode and the arm stay mode in the security system 20 in accordance with disclosed embodiments. As seen in FIG. 4 and as disclosed herein, the security system 20 can switch from the arm away mode to the arm stay mode without switching to the disarm mode in between the arm away mode and the arm stay mode.

For example, the method 300 can include the security system 20 operating in the arm away mode, as in 302. Then, the method 300 can include the security system 20 using the plurality of sensors 24 to determine whether the user has entered the region R, as in 304.

When the security system 20 determines that the user has not entered the region R, as in 304, the method 300 can include the control or user interface device 26 displaying options for the user to select the arm stay mode or the disarm mode, as in 306, the control or user interface device 26 receiving user input selecting the arm stay mode, as in 308, the control or user interface device 26 receiving the pin or the passcode, as in 310, and the security system 20 determining whether the pin or the passcode is valid, as in 312. However, in embodiments in which the control or user interface device 26 is the mobile device executing the mobile application thereon, the method 300 need not require the pin or the passcode.

When the security system 20 determines that the pin or the passcode is valid, as in 312, (or in embodiments that do not require the pin or the passcode, after receiving the user input selecting the arm stay mode, as in 308), the method 300 can include the security system 20 transitioning directly to the arm stay mode and starting an entry delay timer, as in 314. Then, the method 300 can include the security system 20 detecting the user inside of the region R, that is, entering the region, as in 316, and determining whether the user entered the region R prior to expiration of the entry delay timer, as in 318.

When the security system determines that the user entered the region R prior to the expiration of the entry delay timer, as in 318, the method 300 can include the security system 20 maintaining operation in the arm stay mode, as in 320.

However, when the security system 20 determines that the user has not entered the region R prior to the expiration of the entry delay timer, as in 318, the method 300 can include the security system transitioning directly to the arm away mode and the control or user interface device 26 displaying the options for the user to select the arm stay mode or the disarm mode, as in 324.

When the security system 20 determines that the user has entered the region R, as in 304, the method 300 can include the security system 20 starting the entry delay timer, as in 322, the control or user interface device 26 displaying the options for the user to select the arm stay mode or the disarm mode, as in 324, the control or user interface device 26 receiving the user input selecting the arm stay mode, as in 326, the control or user interface device 26 receiving the pin or the passcode, as in 328, and the security system 20 determining whether the pin or the passcode is valid, as in 330.

When the security system 20 determines that the pin or the passcode is valid, as in 330, (or in embodiments that do not require the pin or the passcode, after receiving the user input selecting the arm stay mode, as in 326), the method 300 can include the security system 20 transitioning directly to the arm stay mode, as in 332.

Figure 5:
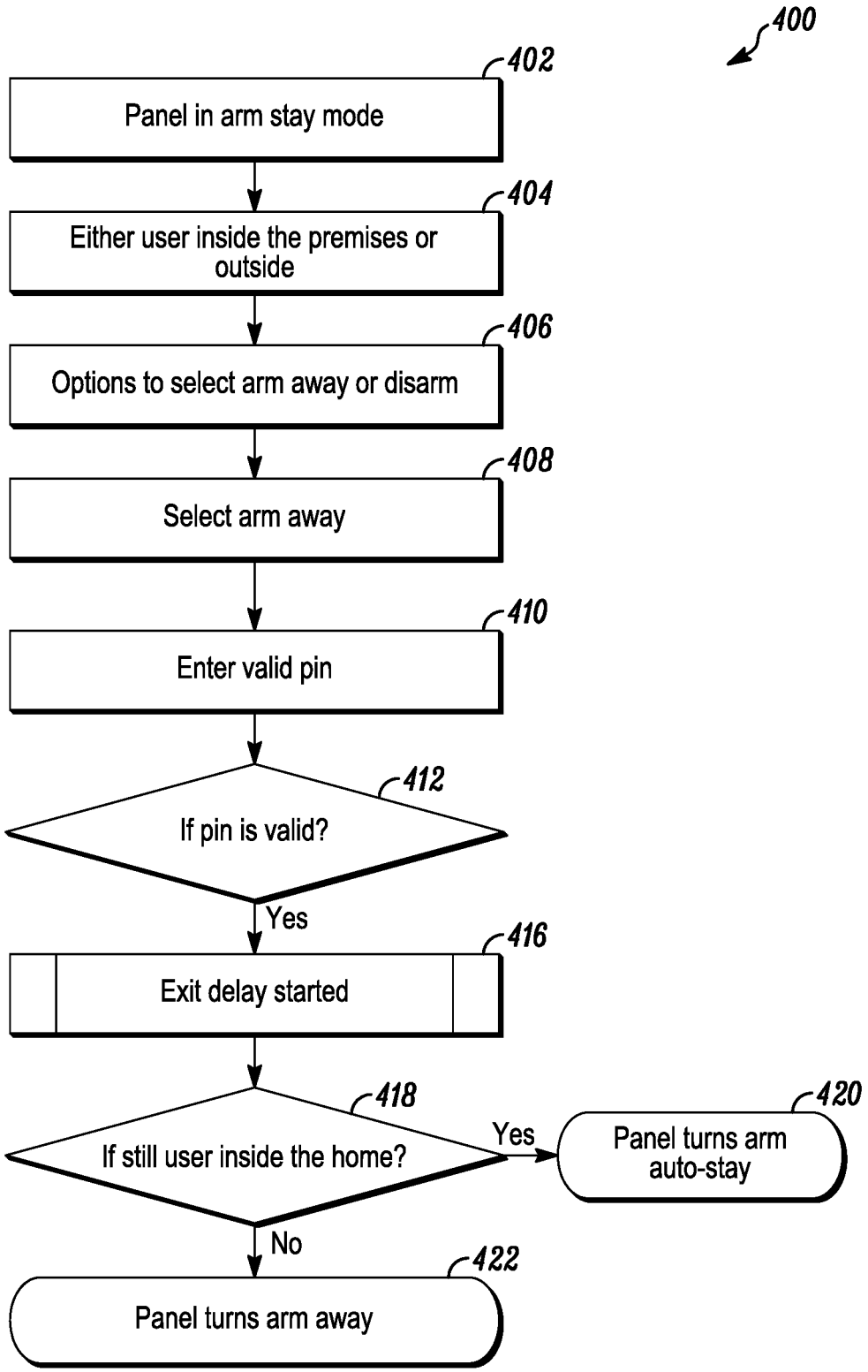
FIG. 5 is a flow diagram of a method of switching between an arm stay mode and an arm away mode in a security system in accordance with disclosed embodiments.

FIG. 5 is a flow diagram of a method 400 of switching between the arm stay mode and the arm away mode in the security system 20 in accordance with disclosed embodiments. As seen in FIG. 5 and as disclosed herein, the security system 20 can switch from the arm stay mode to the arm away mode without switching to the disarm mode in between the arm stay mode and the arm away mode.

For example, the method 400 can include the security system 20 operating in the arm stay mode, as in 402, with the user located either inside or outside of the region R, as in 404. Then, the method 400 can include the control or user interface device 26 displaying options for the user to select the arm away mode or the disarm mode, as in 406, the control or user interface device 26 receiving user input selecting the arm away mode, as in 408, the control or user interface device 26 receiving the pin or the passcode, as in 410, and the security system 20 determining whether the pin or the passcode received is valid as in 412. However, as with the method 300 of FIG. 4, in embodiments in which the control or user interface device 26 is the mobile device executing the mobile application thereon, the method 400 need not require the pin or the passcode.

When the method 400 determines that the pin or the passcode is valid, as in 412, (or in embodiments that do not require the pin or the passcode, after receiving the user input selecting the arm away mode, as in 408), the method 400 can include the security system 20 starting an exit delay timer, as in 416, and using the plurality of sensor 24 to determine whether the user is located inside of the region R, as in 418.

When the method 400 determines that the user is located inside of the region R, the method 400 can include the security system 20 maintaining operation in the arm stay mode or refraining from transitioning to the arm away mode, as in 420.

However, when the method 400 determines that the user is outside of the region R, that is, has exited the region R, the method 400 can include the security system transitioning directly to the arm away mode, as in 422.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A method comprising:

while a security system that protects a monitored region with a plurality of sensors is in a first arm mode, receiving first user input at a control device of the security system;

when the security system is operating in the first arm mode, detecting any of respective alarm conditions associated with each of a first set of the plurality of sensors, and responsive thereto, activating an alarm signal;

when the security system is operating in the second arm mode, detecting any of the respective alarm conditions associated with each of a second set of the plurality of sensors, and responsive thereto, activating the alarm signal, wherein the first set of the plurality of sensors is at least partially different from the second set of the plurality of sensors;

responsive to the first user input, activating a timer and suppressing activation of the alarm signal when any of the plurality of sensors detect the respective alarm conditions associated therewith until expiration of the timer;

responsive to one of the plurality of sensors that monitors an entrance to the monitored region being triggered after activation of the timer and prior to the expiration of the timer directly transitioning the security system from the first arm mode to the second arm mode without transitioning to a disarm mode in between and terminating the timer; and responsive to all of the plurality of sensors that monitor the entrance failing to be triggered after the activation of the timer and prior to the expiration of the timer, directly transitioning the security system from the second arm mode to the first arm mode or refraining from transitioning out of the first arm mode when the timer expires.

2. The method of claim 1 wherein the first arm mode includes an arm away mode and the second arm mode includes an arm stay mode.

3. The method of claim 2 wherein the first set of the plurality sensors includes all of the plurality of sensors and the second set of the plurality of sensors includes a subset of the plurality of sensors, and wherein each of the subset of the plurality of sensors is capable of detecting the respective alarm conditions associated therewith at or proximate to a perimeter of the monitored region.

4. The method of claim 2 wherein the timer includes an entry delay timer.

5. The method of claim 1 wherein the first arm mode includes an arm stay mode and the second arm mode includes an arm away mode.

6. The method of claim 5 wherein the first set of the plurality sensors includes a subset of the plurality of sensors and the second set of the plurality of sensors includes all of the plurality of sensors, and wherein each of the subset of the plurality of sensors is capable of detecting the respective alarm conditions associated therewith at or proximate to a perimeter of the monitored region.

7. The method of claim 5 further comprising:

directly transitioning the security system to the arm stay mode when any of the plurality of sensors detects a presence of a user inside of the monitored region, wherein the timer includes an exit delay timer.

8. The method of claim 1 wherein the first arm mode includes an arm stay mode and the second arm mode includes an arm night mode.

9. The method of claim 8 wherein the first set of the plurality sensors includes a first subset of the plurality of sensors and the second set of the plurality of sensors includes a second subset of the plurality of sensors, wherein the first subset of the plurality of sensors is capable of detecting the respective alarm conditions associated therewith at or proximate to a perimeter of the monitored region, and wherein the second set of the plurality of sensors includes all of the plurality of sensors except for those of the plurality of sensors within a predetermined zone of the monitored region.

10. The method of claim 1 further comprising:

responsive to receiving the first user input, soliciting second user input at the control device;

determining whether the second user input is valid; and responsive to determining that the second user input is valid, directly transitioning the security system from the first arm mode to the second arm mode without switching to the disarm mode in between the first arm mode and the second arm mode.

11. A system comprising:

a control device of a security system that protects a monitored region; and a plurality of sensors of the security system, each of which monitors respective alarm conditions, wherein the control device receives first user input while the security system is in a first arm mode, wherein, when the security system is operating in the first arm mode, each of a first set of the plurality of sensors detects any of the respective alarm conditions associated therewith, and responsive thereto, the security system activates an alarm signal, wherein, when the security system is operating in a second arm mode, each of a second set of the plurality of sensors detects any of the respective alarm conditions associated therewith, and responsive thereto, the security system activates the alarm signal, wherein the first set of the plurality of sensors is at least partially different from the second set of the plurality of sensors, wherein, responsive to the first user input, the security system activates a timer and suppresses activation of the alarm signal responsive to any of the plurality of sensors detecting the respective alarm conditions associated therewith until expiration of the timer, wherein, responsive to one of the plurality of sensors that monitors an entrance to the monitored region being triggered after activation of the timer and prior to the expiration of the timer, the security system directly transitions from the first arm mode to the second arm mode without transitioning to a disarm mode in between and terminates the timer, and wherein, responsive to all of the plurality of sensors that monitor the entrance failing to be triggered after the activation of the timer and prior to the expiration of the timer, the security system directly transitions from the second arm mode to the first arm mode or refrains from transitioning out of the first arm mode when the timer expires.

12. The system of claim 11 wherein the first arm mode includes an arm away mode and the second arm mode includes an arm stay mode.

13. The system of claim 12 wherein the first set of the plurality sensors includes all of the plurality of sensors and the second set of the plurality of sensors includes a subset of the plurality of sensors, and wherein each of the subset of the plurality of sensors is capable of detecting the respective alarm conditions associated therewith at or proximate to a perimeter of the monitored region.

14. The system of claim 12 wherein the timer includes an entry delay timer.

15. The system of claim 11 wherein the first arm mode includes an arm stay mode and the second arm mode includes an arm away mode.

16. The system of claim 15 wherein the first set of the plurality sensors includes a subset of the plurality of sensors and the second set of the plurality of sensors includes all of the plurality of sensors, and wherein each of the subset of the plurality of sensors is capable of detecting the respective alarm conditions associated therewith at or proximate to a perimeter of the monitored region.

17. The system of claim 15 wherein the timer includes an exit delay timer, and wherein the security system transitions directly to the arm stay mode when any of the plurality of sensors detects a presence of a user inside of the monitored region.

18. The system of claim 11 wherein the first arm mode includes an arm stay mode and the second arm mode includes an arm night mode.

19. The system of claim 18 wherein the first set of the plurality sensors includes a first subset of the plurality of sensors and the second set of the plurality of sensors includes a second subset of the plurality of sensors, wherein the first subset of the plurality of sensors is capable of detecting the respective alarm conditions associated therewith at or proximate to a perimeter of the monitored region, and wherein the second set of the plurality of sensors includes all of the plurality of sensors except for those of the plurality of sensors within a predetermined zone of the monitored region.

20. The system of claim 11 wherein, responsive to receiving the first user input, the control device solicits second user input, wherein the security system determines whether the second user input is valid, and, wherein, responsive to determining that the second user input is valid, the security system directly transitions from the first arm mode to the second arm security mode without switching to the disarm mode in between the first arm mode and the second arm mode.

* * * * *